US008292300B2

(12) United States Patent
Moore, III

(10) Patent No.: US 8,292,300 B2
(45) Date of Patent: Oct. 23, 2012

(54) PORTABLE FOLDING SPORTS GOAL

(76) Inventor: J. Brantley Moore, III, Danville, CA (US)

( * ) Notice: Subject to any disclaimer, the term of this patent is extended or adjusted under 35 U.S.C. 154(b) by 2024 days.

(21) Appl. No.: 10/956,869

(22) Filed: Sep. 30, 2004

(65) Prior Publication Data

US 2005/0067785 A1 Mar. 31, 2005

Related U.S. Application Data

(60) Provisional application No. 60/507,683, filed on Sep. 30, 2003.

(51) Int. Cl.
*A63B 63/00* (2006.01)

(52) U.S. Cl. ..... 273/400; 473/478

(58) Field of Classification Search ..... 273/398–402; 473/476, 478

See application file for complete search history.

(56) References Cited

U.S. PATENT DOCUMENTS 4,420,158 A 12/1983 Klock et al.
5,080,375 A * 1/1992 Moosavi ..... 473/478
5,346,227 A * 9/1994 Amram et al. ..... 273/400
5,421,586 A 6/1995 Amram et al.
5,539,957 A * 7/1996 Schmidt ..... 16/331
5,655,774 A * 8/1997 Cox ..... 473/478
5,695,195 A * 12/1997 John et al. ..... 273/400
5,842,939 A * 12/1998 Pui et al. ..... 473/478
5,857,928 A 1/1999 Stewart
5,954,600 A 9/1999 Gill
6,209,878 B1 4/2001 Munro
6,652,395 B2 * 11/2003 Goldwitz ..... 473/478
2003/0153412 A1 * 8/2003 Duba et al. ..... 473/478

* cited by examiner

*Primary Examiner* — Mark Graham
(74) *Attorney, Agent, or Firm* — Nancy R. Simon

(57) ABSTRACT

An upper bar and a lower bar are parallel with respect to each other and are separated by a distance. A slanted bar, vertical bar, and side bar form a triangular frame with one end of the slanted bar and one end of the vertical bar connected to one end of the upper bar. The opposing end of the vertical bar is releasably connected to one end of the side bar while the opposing end of the side bar is connected to the lower bar. Another slanted bar, vertical bar, and side bar are similarly connected at the other end of the upper and lower bars. The upper bar, lower bar, and two slanted bars include releasably connected tubular members. And both ends of the slanted bars are connected with rotatable joints. Netting may be woven onto the upper bar, the lower bar, the vertical bars, and the side bars.

18 Claims, 12 Drawing Sheets

PORTABLE FOLDING SPORTS GOAL

CROSS-REFERENCE TO RELATED APPLICATIONS

This application claims the benefit of U.S. Provisional Application 60/507,683 filed on Sep. 30, 2003.

BACKGROUND

Field goals are used in a number of sports during organized or informal games, practice sessions, or both. Some playing fields have permanent sports goals, which are typically costly to install and maintain. Other playing fields require the team or players to set up portable sports goals for games or practice sessions.

There are several types of portable sports goals. One type, for example, breaks into individual sections or components. Each section may then be carried by a person. Assembling and disassembling goals of this type, however, can sometimes be difficult or time-consuming.

Another type of portable sports goal folds the side sections onto the back section and the entire goal may then be transported. Unfortunately, some goals can be difficult to carry and transport. The goal may be heavy, thereby making it difficult for a person to carry. Moreover, depending on the size of the goal, a larger vehicle may be needed to transport the goal.

SUMMARY

In accordance with the invention, a portable folding sports goal is provided. The portable folding sports goal includes an upper bar, a lower bar, two slanted bars, two vertical bars, and two side bars. The upper and lower bars are parallel with respect to each other and are separated by a distance. One slanted bar, one vertical bar, and one side bar form a triangular frame with one end of the slanted bar and one end of the vertical bar connected to one end of the upper bar. The opposing end of the vertical bar is releasably connected to one end of the side bar while the opposing end of the side bar is connected to the lower bar. The other slanted bar, vertical bar, and side bar are similarly connected at the other end of the upper and lower bars. Rotatable joints connect the ends of the slanted bars to the upper and lower bars. The upper bar, lower bar, and two slanted bars include releasably connected tubular members. Netting may be woven onto the upper bar, the lower bar, the vertical bars, and the side bars. The goal may be broken down and folded into pieces with the pieces remaining connected.

BRIEF DESCRIPTION OF THE DRAWINGS

The invention will best be understood by reference to the following detailed description of embodiments in accordance with the invention when read in conjunction with the accompanying drawings, wherein.

DETAILED DESCRIPTION

The following description is presented to enable one skilled in the art to make and use embodiments of the invention, and is provided in the context of a patent application and its requirements. Various modifications to the disclosed embodiments will be readily apparent to those skilled in the art, and the generic principles herein may be applied to other embodiments. Thus, the invention is not intended to be limited to the embodiments shown, but is to be accorded the widest scope consistent with the appended claims and with the principles and features described herein.

Figure 1:
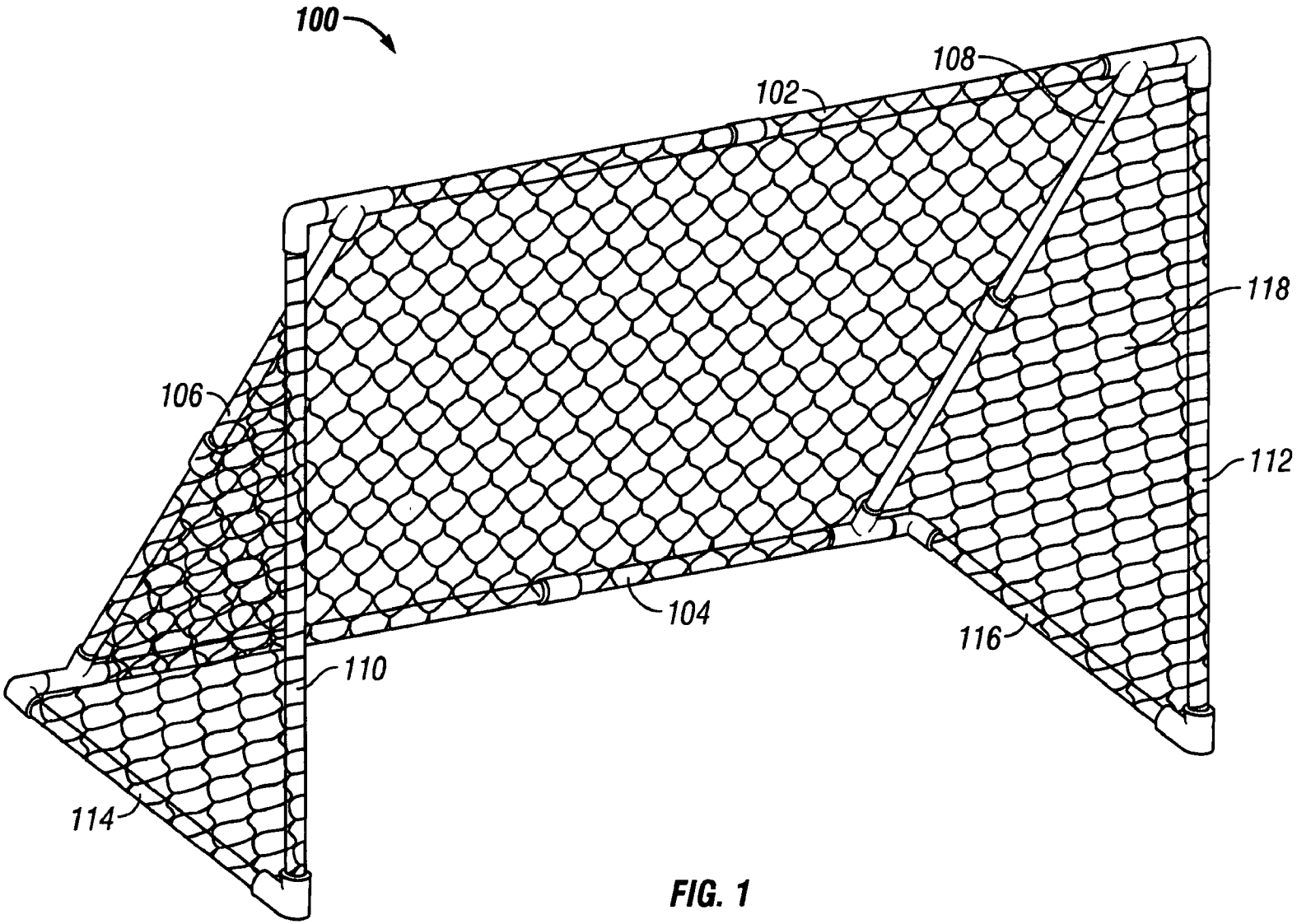
FIG. 1 is a perspective view of a portable folding sports goal in an embodiment in accordance with the invention.

With reference to the figures and in particular with reference to FIG. 1, there is shown a perspective view of a portable folding sports goal in an embodiment in accordance with the invention. Goal 100 includes upper horizontal bar 102, lower horizontal bar 104, slanted bars 106, 108, vertical bars 110, 112, and side bars 114, 116. Lower horizontal bar 104 and side bars 114, 116 lie on the ground.

Netting 118 overlies slanted bars 106, 108 and is woven onto upper horizontal bar 102, lower horizontal bar 104, vertical bars 110, 112, and side bars 114, 116 in one embodiment in accordance with the invention. Netting 118 may be affixed to goal 100 differently in other embodiments in accordance with the invention. For example, netting 118 may be affixed to goal 100 with cloth ties or Velco™ straps.

Figure 2:
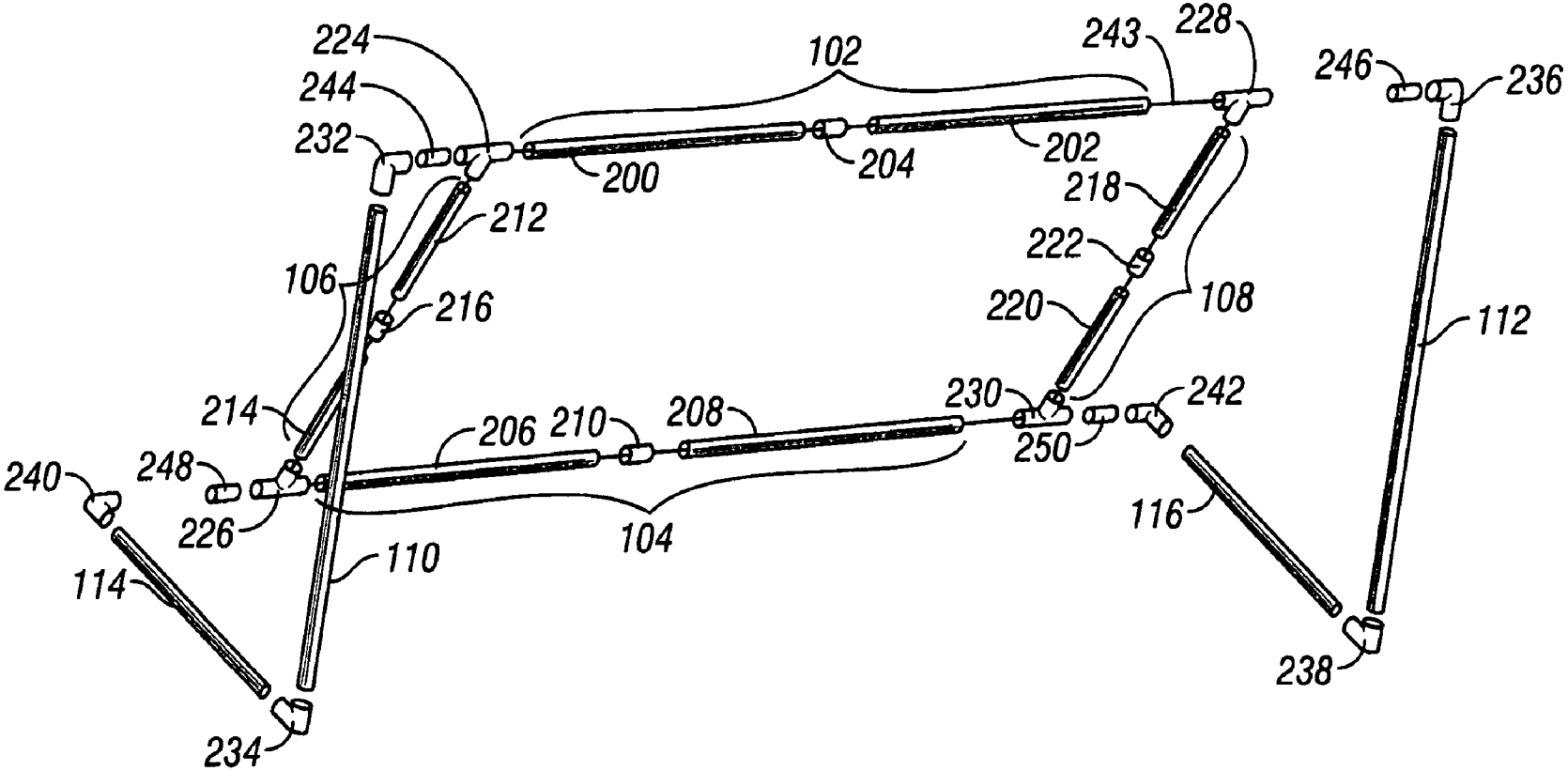
FIG. 2 is an exploded perspective view of a portable folding sports goal in an embodiment in accordance with the invention.

FIG. 2 is an exploded perspective view of a portable folding sports goal in an embodiment in accordance with the invention. Upper horizontal bar 102 includes tubular support members 200, 202 that are connectable to collar or connector 204. Lower horizontal bar 104 includes tubular support members 206, 208 that are connectable to connector 210. Slanted bar 106 includes tubular support members 212, 214 that are connectable to connector 216 and slanted bar 108 includes tubular support members 218, 220 connectable to connector 222.

In the embodiment of FIG. 2, t-connector 224 connects one end of member 212 to upper horizontal bar 102 while T-connector 226 connects one end of member 214 to lower horizontal bar 104. Similarly, T-connector 228 connects one end of member 218 to the other end of upper horizontal bar 102 while T-connector 230 connects one end of member 220 to the other end of lower horizontal bar 104.

Elbow connectors 232, 234 connect vertical bar 110 to upper horizontal bar 102 and side bar 114, respectively. Elbow connector 240 connects the other end of side bar 114 to lower horizontal bar 104. Elbow connectors 236, 238 connect vertical bar 112 to upper horizontal bar 102 and side bar 116, respectively. And elbow connector 242 connects the other end of side bar 116 to lower horizontal bar 104.

Vertical bars 110, 112 and side bars 114, 116 are formed with uninterrupted tubular members. Bars 102-116 and connectors 204, 210, 216, 222, 224-242 are formed from any material. For example, in one embodiment in accordance with the invention, all of the bars and connectors are constructed with plastic pipes such as PVC piping.

Internal cord 243 runs through upper horizontal bar 102, slanted bars 106, 108 and lower horizontal bar 104. Internal cord 243 provides resistance that assists in maintaining the shape of goal 100. Internal cord 243 may be implemented with any type of cord. For example, in one embodiment in accordance with the invention, internal cord 243 is a bungee cord. In other embodiments in accordance with the invention, cord 243 may be implemented with different types of cord, such as, for example, a rope or wire.

Figure 3:
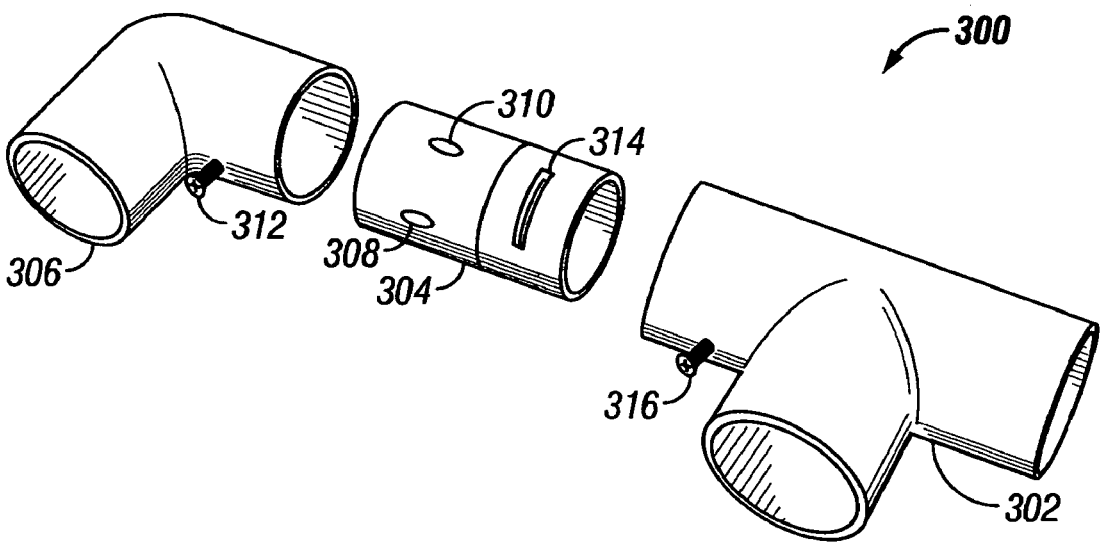
FIG. 3 is a view of a rotatable joint in an embodiment in accordance with the invention.

Referring to FIG. 3, there is shown an exploded view of a rotatable joint in an embodiment in accordance with the invention. Rotatable joint 300 includes t-connector 302, nipple (short length of tubular material) 304, and elbow connector 306. When constructed, the ends of nipple 304 are inserted into t-connector 302 and elbow connector 306. In one embodiment in accordance with the invention, t-connector 224, nipple 244, and elbow connector 232 in FIG. 2, t-connector 228, nipple 246, and elbow connector 236 in FIG. 2, t-connector 226, nipple 248, and elbow connector 240 in FIG.

2, and t-connector 230, nipple 250, and elbow connector 242 are constructed as rotatable joints.

Nipple 304 includes holes 308, 310. Screw 312 extends into hole 308 or hole 310, depending on the configuration. Screw 312, when inserted into hole 308 or 310, prevents rotatable joint 300 from pulling apart during assembly, disassembly, or while the goal is in use.

Nipple 304 also includes slot 314 into which screw 316 extends. When rotatable joint 300 is assembled and connected to vertical bars 110, 112, rotatable joint 300 will rotate or swivel with respect to the upper horizontal bar 102. Rotatable joint 300 is also connected to support members 214, 220 and rotatable joint 300 rotates with respect to lower horizontal bar 104. Vertical bars 110, 112 and support members 214, 220 rotate during assembly and disassembly of the goal.

Figure 4:
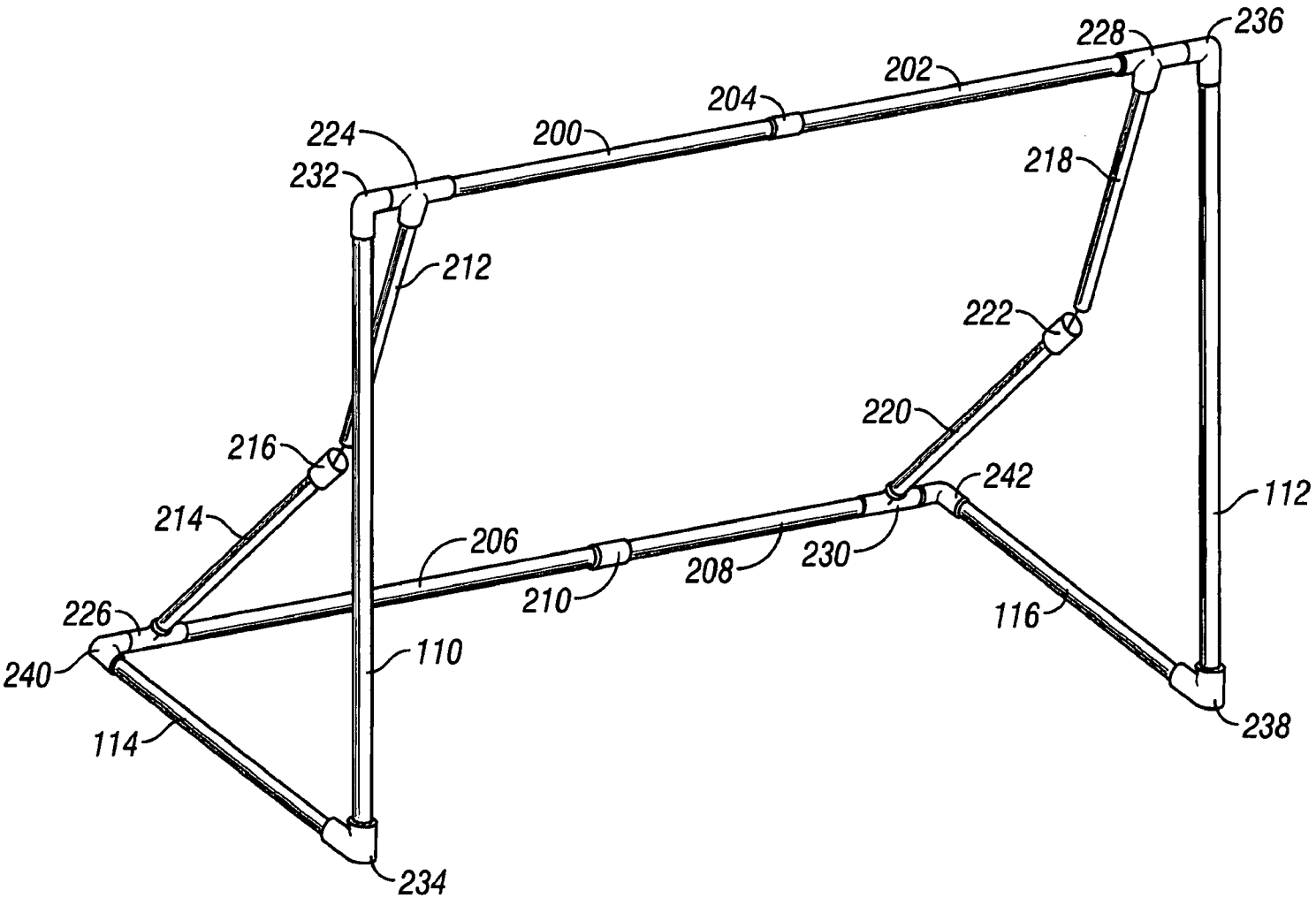
FIGS. 4-12 illustrate a method for disassembling a portable folding sports goal in an embodiment in accordance with the invention.

Although rotatable joint 300 is shown in FIG. 4 as being constructed with t-connector 302, nipple 304, and elbow connector 306, embodiments in accordance with the invention are not limited to this construction. Different types of rotatable joints that allow vertical bars 110, 112 to rotate with respect to upper horizontal bar 102 and allow support members 214, 220 to rotate with respect to lower horizontal bar 104 may be used in other embodiments in accordance with the invention.

FIGS. 4-12 illustrate a method for disassembling a portable folding sports goal in an embodiment in accordance with the invention. In one embodiment in accordance with the invention, a removable net is affixed to the goal. In another embodiment in accordance with the invention, a net is woven onto the goal. Netting is not shown in FIGS. 4-12 for clarity.

Figure 5:
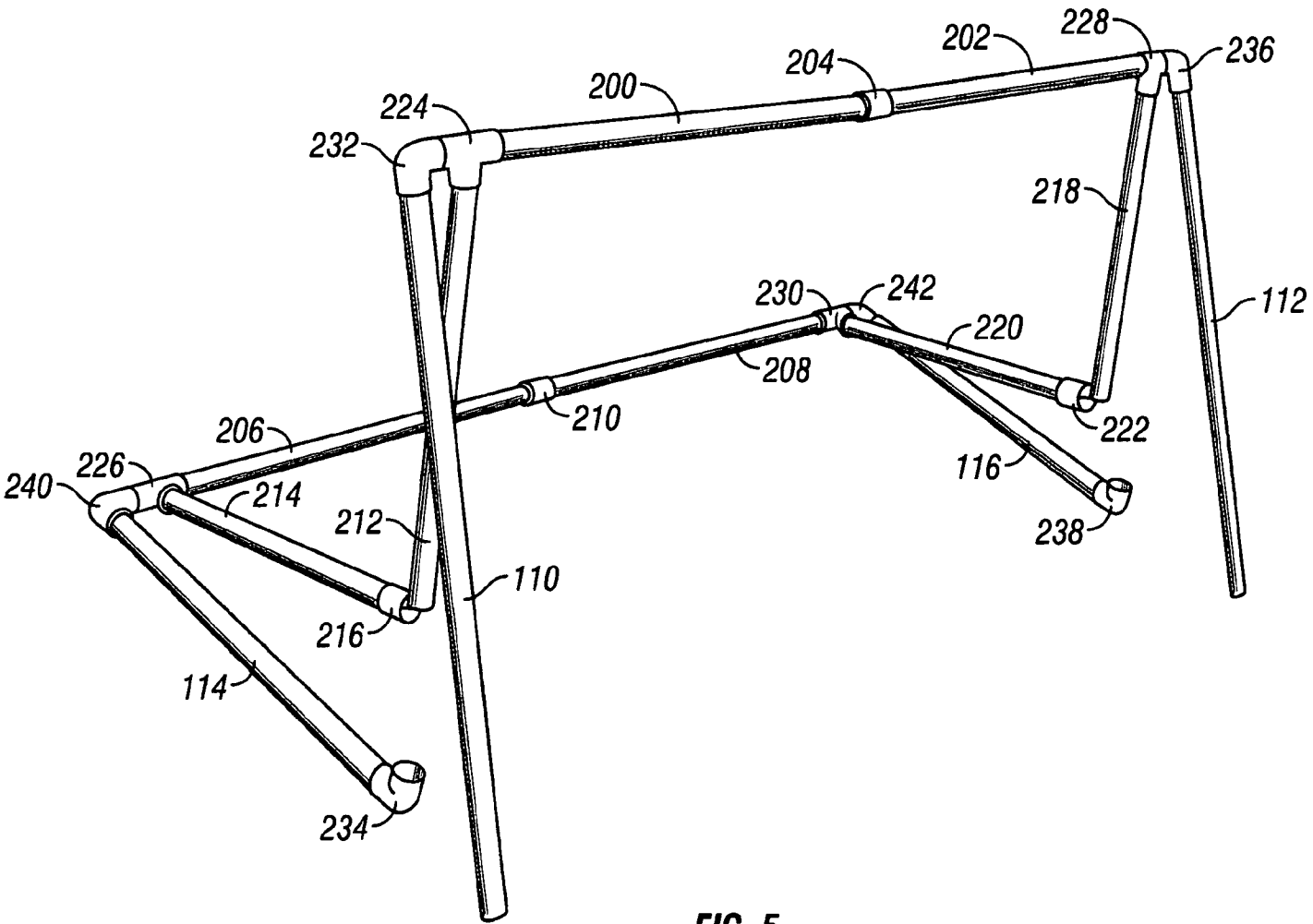
Figure 6:
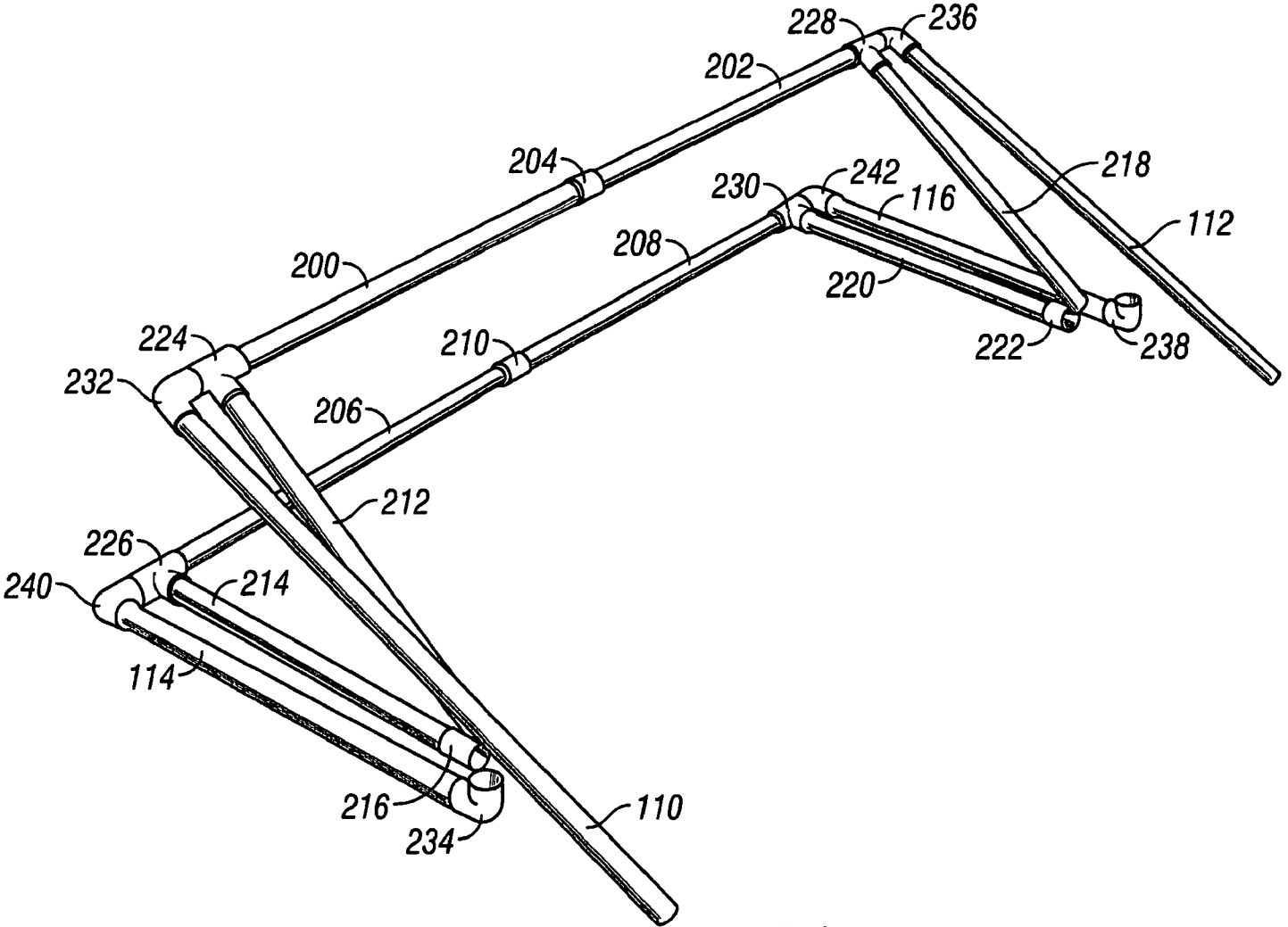
Figure 7:
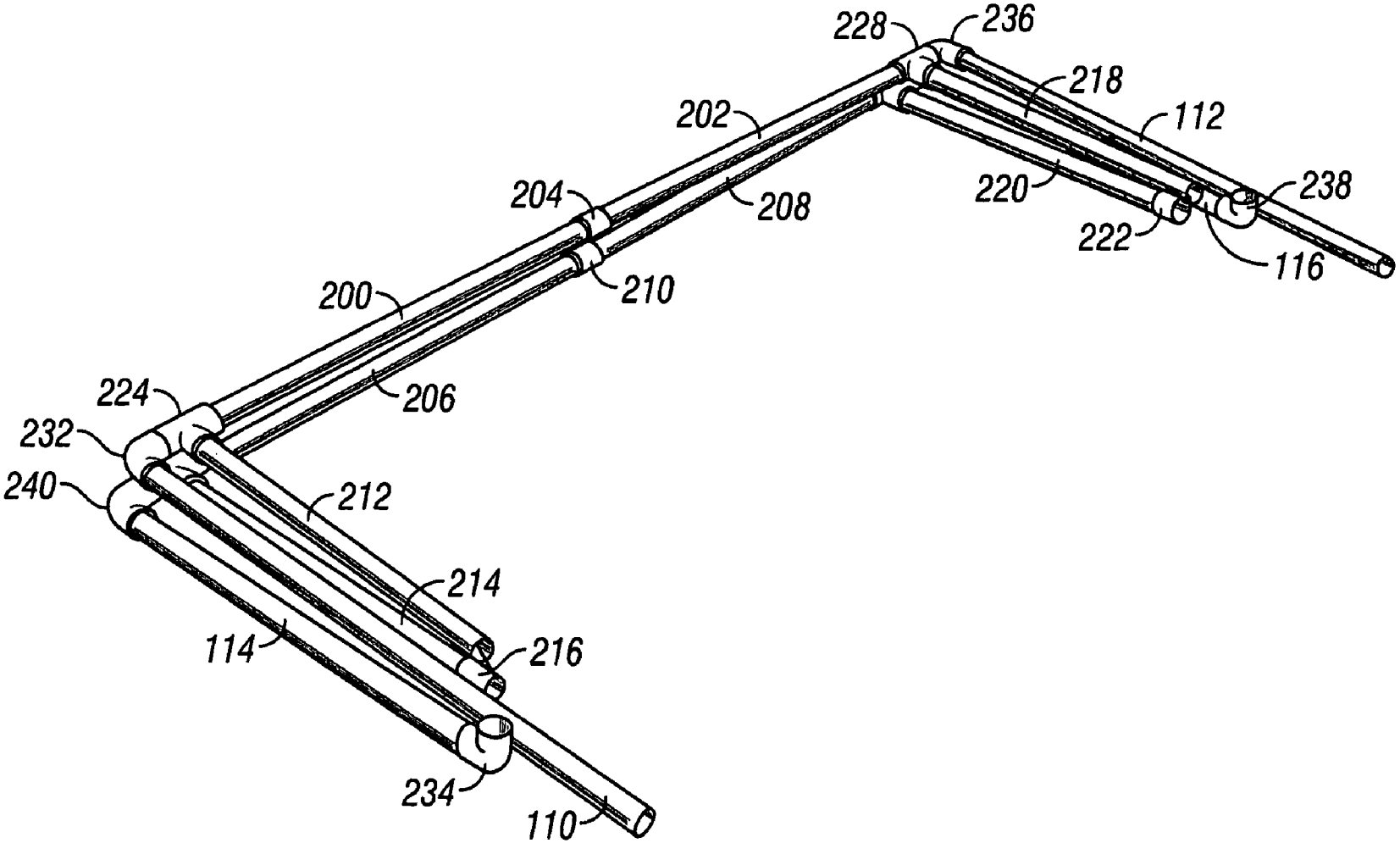

FIG. 4 illustrates support member 212 separated from connector 216 and support member 218 removed from connector 222. This allows support members 214, 220 to drop towards side bars 114, 116, respectively. Next, as shown in FIG. 5, vertical bars 110, 112 are separated from elbow connectors 234, 238, respectively. This allows upper horizontal bar 102 to drop towards lower horizontal bar 104 (see FIG. 6). When upper horizontal bar 102 rests on top of lower horizontal bar 104, as illustrated in FIG. 7, support members 200, 206 are pulled out of connectors 204, 210, respectively (see FIG. 8). This splits the goal into two sections.

Figure 9:
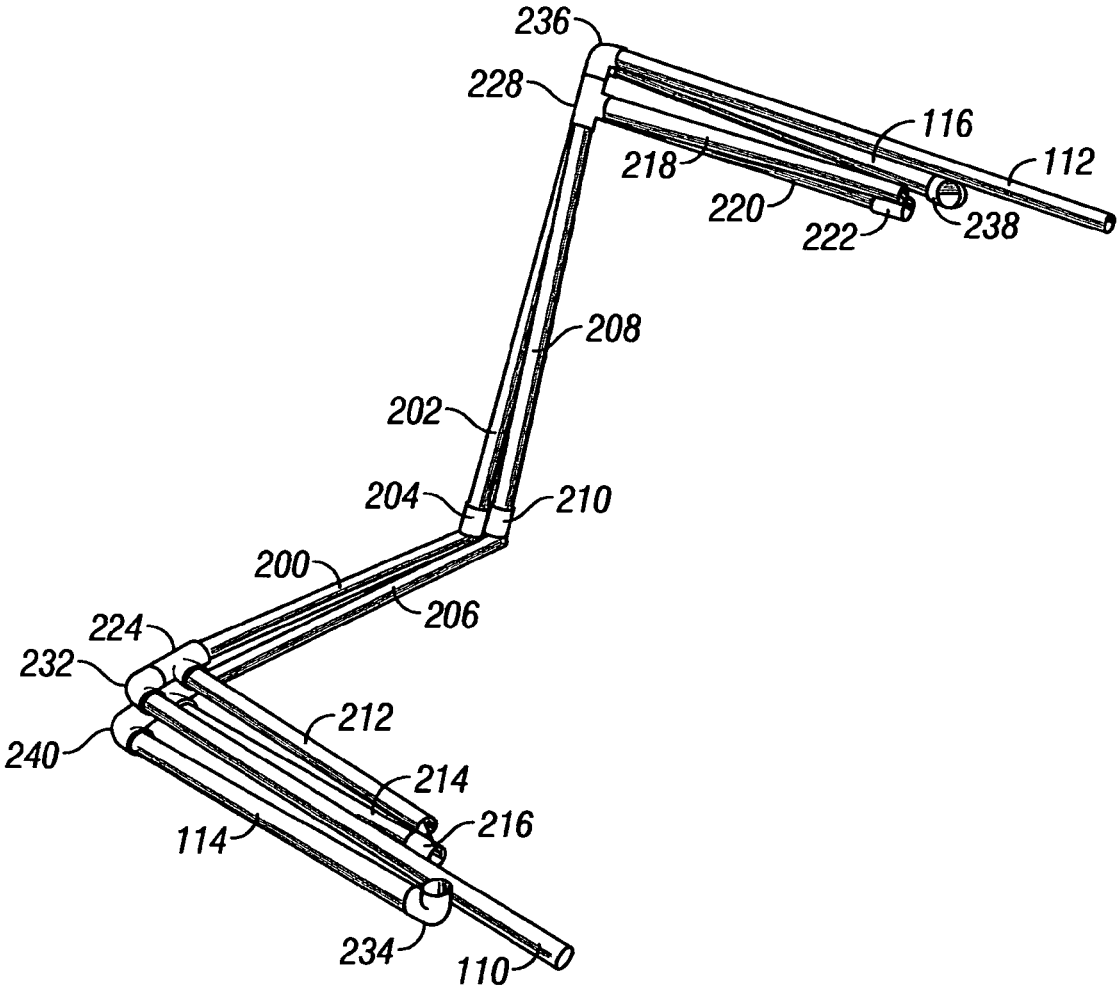
Figure 10:
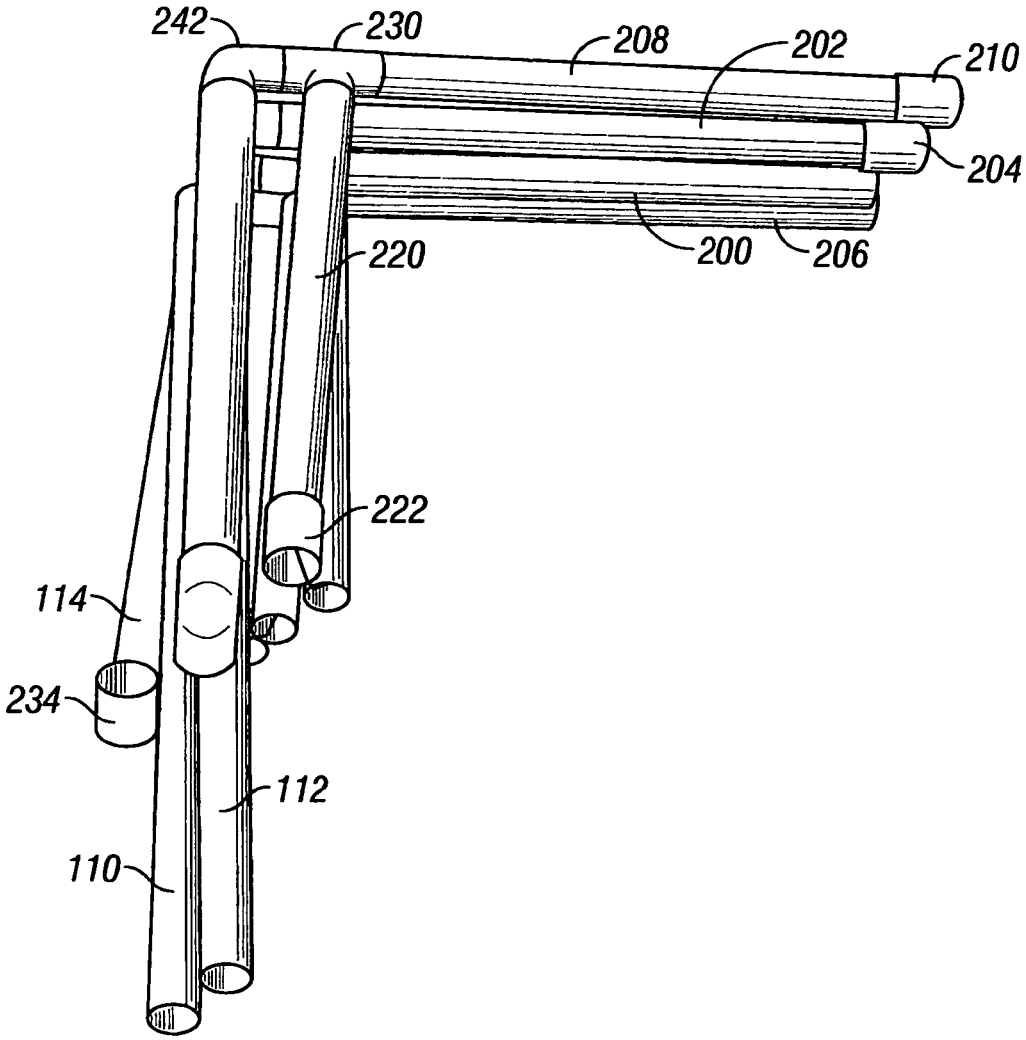
Figure 11:
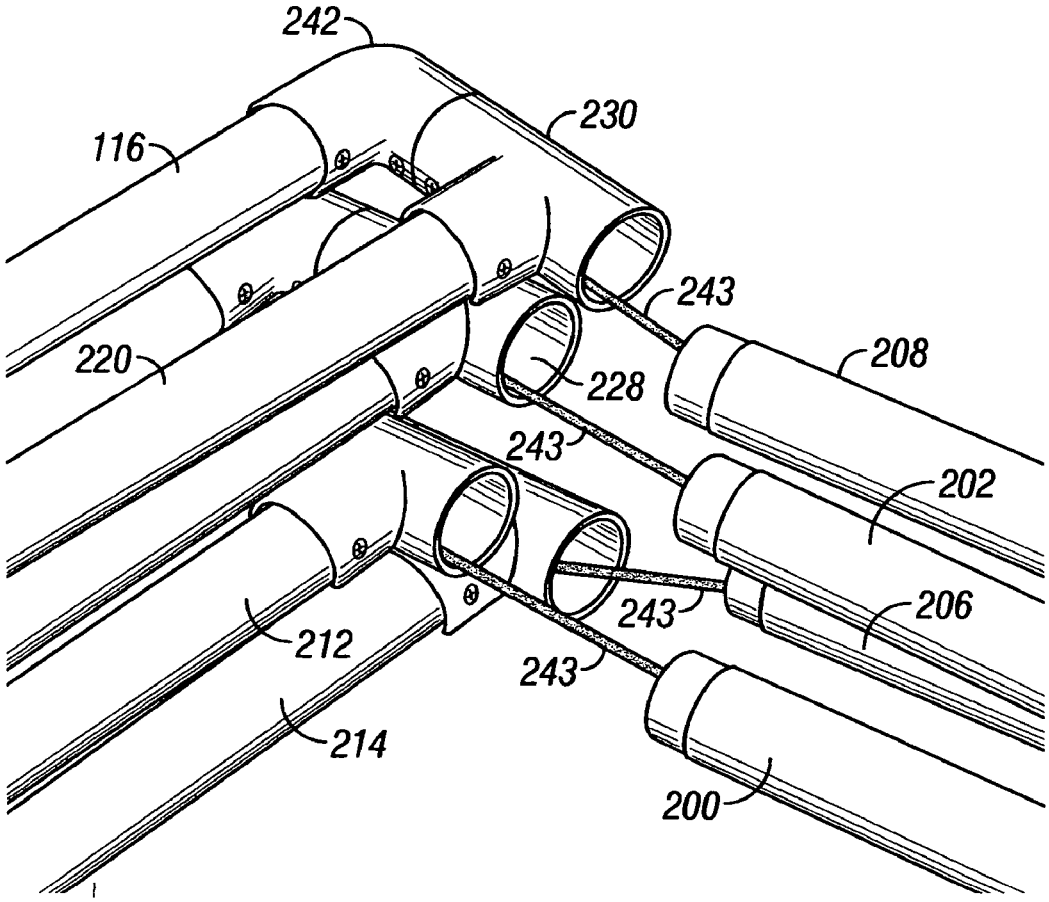

One section is then rotated upwards with respect to the other section. For example, FIG. 9 illustrates the right section rotated upwards with respect to the left section. Rotation of the right section continues until the right section rests on top of the left section, as shown in FIG. 10. Support members 200, 202, 206, 208 are then separated from t-connectors 224, 228, 226, 230, respectively (FIG. 11; see also FIG. 2). Once separated, support members, 200, 202, 206, 208 are moved towards the other bars such that all of the bars are parallel, as shown in FIG. 12.

In one embodiment in accordance with the invention, the ends of support members 200, 202, 206, 208, 212, 214, 28, 220, vertical bars 110, 112, and side bars 114, 116 are reduced in diameter so that the ends will fit lightly in the connectors. This allows the ends to be easily inserted and separated from their respective connectors. Support members 200, 202, 206, 208, 212, 214, 28, 220, vertical bars 110, 112, and side bars 114, 116 and their corresponding connectors can be constructed differently in other embodiments in accordance with the invention. For example, different types and sizes of connectors may be used. Some connectors may be smaller in diameter than the ends of corresponding support members 200, 202, 206, 208, 212, 214, 28, 220, vertical bars 110, 112 or side bars 114, 116, thereby allowing the ends of the connectors to be inserted into the ends of the members or bars.

Figure 12:
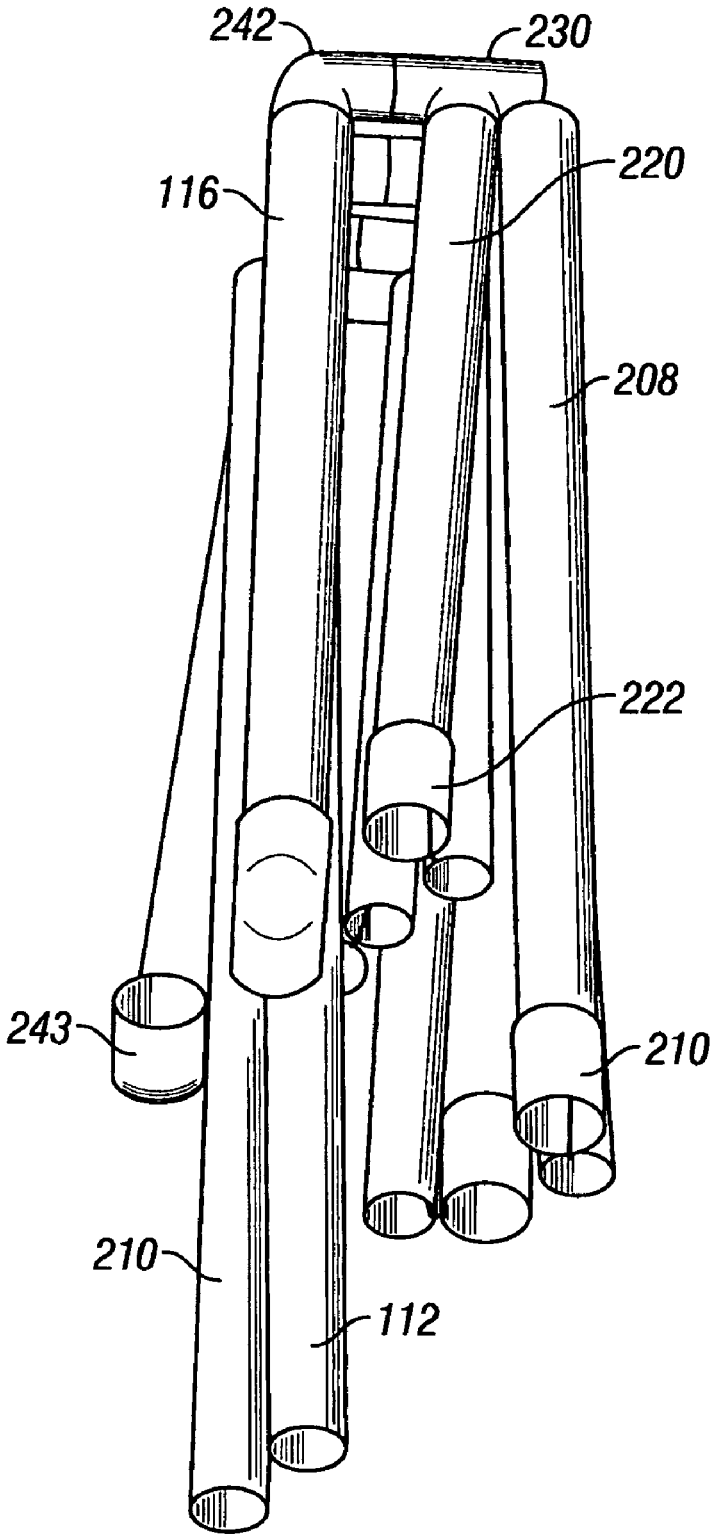

The portable folding sports goal can also be assembled using the method shown in FIGS. 4-12. The steps are performed in reverse order, in that a user begins with a disassembled goal as shown in FIG. 12. The user separates support members 200, 202, 206, 208 and inserts members 200, 202, 206, 208 into respective t-connectors 224, 228, 226, 230 (FIG. 11, FIG. 10).

Figure 8:
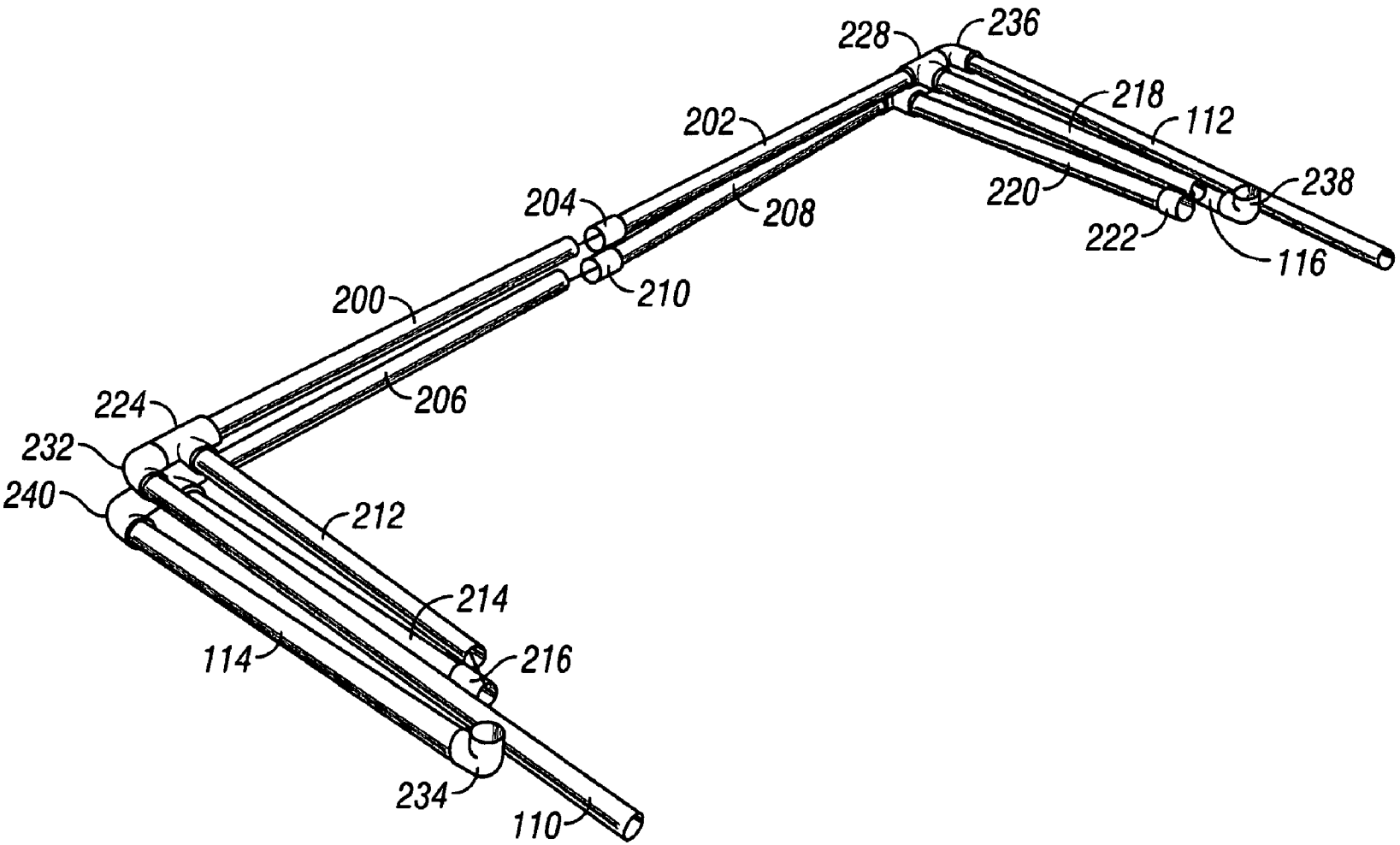

One section of the goal is then rotated up and away from the other section (FIG. 9) until the two sections are separated as shown in FIG. 8. Support members 200, 206 are inserted into connectors 204, 210, respectively, and upper horizontal bar 102 is rotated upwards away from lower horizontal bar (FIG. 7, FIG. 6, FIG. 5). Vertical bars 110, 112 are then inserted into elbow connectors 234, 238 and support members 212, 218 inserted into connectors 216, 222, respectively (FIG. 4).

The invention claimed is:

1. A portable sports goal, comprising:

an upper bar comprised of releasably interconnected tubular members;

a lower bar comprised of releasably interconnected tubular members;

a first vertical bar connected to a first end of the upper bar and releasably connected to a first end of a first side bar, wherein an opposing second end of the first side bar is connected to a first end of the lower bar;

a second vertical bar connected to an opposing second end of the upper bar and releasably connected to a first end of a second side bar, wherein an opposing second end of the second side bar is connected to an opposing second end of the lower bar;

a first slanted bar comprised of releasably connected tubular members, wherein a first end of the first slanted bar is connected to the first end of the upper bar through a first rotatable joint and an opposing second end of the first slanted bar is connected to the first end of the lower bar through a second rotatable joint; and a second slanted bar comprised of releasably connected tubular members, wherein a first end of the second slanted bar is connected to the second end of the upper bar through a third rotatable joint and an opposing second end of the second slanted bar is connected to the second end of the lower bar through a fourth rotatable joint so that when the releasably connected tubular members of the first slanted bar are disconnected and the releasably connected tubular members of the second slanted bar are disconnected and the first and second vertical bars are disconnected from the first ends of the first and second side bars, respectively, the upper bar lowers towards the lower bar using the first, second, third, and fourth rotatable joints until the upper bar substantially rests on top of the lower bar.

2. The portable sports goal of claim 1, further comprising a netting configured to attach to the upper bar, the lower bar, the first vertical bar, the second vertical bar, the first side bar, and the second side bar.

3. The portable sports goal of claim 1, further comprising a cord interior to the tubular members of the upper bar, the tubular members of the lower bar, the tubular members of the first slanted bar, and the tubular members of the second slanted bar.

4. The portable sports goal of claim 1, wherein the first and third rotatable joints each comprise:

a first tubular T connector;

a first tubular connector;

a second tubular connector inserted into the first tubular T connector and the first tubular connector and configured to allow the first and third rotatable joints to rotate with respect to the upper bar.

5. The portable sports goal of claim 1, wherein the second and fourth rotatable joints each comprise:

a second tubular T connector;

a third tubular connector;

a fourth tubular connector inserted into the second tubular T connector and the third tubular connector and configured to allow the second and fourth rotatable joints to rotate with respect to the lower bar.

6. A portable sports goal, comprising:

a first collapsible triangular frame;

a second collapsible triangular frame;

an upper bar comprised of foldable interconnected members; and a lower bar comprised of foldable interconnected members, wherein a first end of the upper bar is connected to the first collapsible triangular frame through a first rotatable joint and a first end of the lower bar is connected to the first collapsible triangular frame through a second rotatable joint, and wherein an opposing second end of the upper bar is connected to the second collapsible triangular frame through a third rotatable joint and an opposing second end of the lower bar is connected to the second collapsible triangular frame through a fourth rotatable joint wherein the upper bar lowers onto the lower bar using the first, second, third, and fourth rotatable joints when the first and second triangular frames are collapsed.

7. The portable sports goal of claim 6, wherein the first collapsible triangular frame comprises:

a first vertical bar;

a first side bar; and a first slanted bar comprised of foldable interconnected members, wherein a first end of the first vertical bar is releasably connected to a first end of the first side bar and an opposing second end of the first vertical bar is connected through the first rotatable joint to a first end of the first slanted bar and an opposing second end of the first slanted bar is connected through the second rotatable joint to an opposing second end of the first side bar.

8. The portable sports goal of claim 7, wherein the second collapsible triangular frame comprises:

a second vertical bar;

a second side bar; and a second slanted bar comprised of foldable interconnected members, wherein a first end of the second vertical bar is releasably connected to a first end of the second side bar and an opposing second end of the second vertical bar is connected through the third rotatable joint to a first end of the second slanted bar and an opposing second end of the second slanted bar is connected through the fourth rotatable joint to an opposing second end of the second side bar.

9. The portable sports goal of claim 8, further comprising a netting woven onto the upper bar, the lower bar, the first and second vertical bars, and the first and second side bars.

10. The portable sports goal of claim 8, wherein the foldable interconnected members of the upper bar, the lower bar, the first slanted bar, and the second slanted bar each comprise releasable interconnected tubular members.

11. The portable sports goal of claim 10, further comprising a cord interior to the releasably interconnected tubular members of the upper bar, lower bar, the first slanted bar, and the second slanted bar.

12. The portable sports goal of claim 8, wherein the first and third rotatable joints each comprise:

a first tubular T connector;

a first tubular connector; and a second tubular connector inserted into the first tubular T connector and the first tubular connector and configured to allow the first and third rotatable joints to rotate with respect to the upper bar.

13. The portable sports goal of claim 8, wherein the second and fourth rotatable joints each comprise:

a second tubular T connector;

a third tubular connector; and a fourth tubular connector inserted into the second tubular T connector and the third tubular connector and configured to allow the second and fourth rotatable joints to rotate with respect to the lower bar.

14. A method for producing a portable sports goal, comprising:

providing a first collapsible triangular frame;

providing a second collapsible triangular frame;

providing a foldable upper bar;

providing a first rotatable joint configured to attach a first end of the foldable upper bar to the first collapsible triangular frame;

providing a second rotatable joint configured to attach a second end of the foldable upper bar to the second collapsible triangular frame;

providing a foldable lower bar;

providing a third rotatable joint configured to attach a first end of the foldable lower bar to the first collapsible triangular frame; and providing a fourth rotatable joint configured to attach a second end of the foldable lower bar to the second collapsible frame, wherein the upper bar lowers onto the lower bar using the first, second, third, and fourth rotatable joints when the first and second triangular frames are collapsed.

15. The method of claim 14, wherein providing a first collapsible triangular frame comprises:

providing a first vertical bar;

providing a first side bar;

providing a first slanted bar comprised of foldable interconnected members; and providing a first connector configured to releasably connect a first end of the first vertical bar to a first end of the first side bar, wherein a second end of the first vertical bar connects with the first end of the foldable upper bar through the first rotatable joint and a second end of the first side bar connects with the first end of the foldable lower bar through the third rotatable joint.

16. The method of claim 15, wherein providing a second collapsible triangular frame comprises:

providing a second vertical bar;

providing a second side bar; and providing a second slanted bar comprised of foldable interconnected members; and providing a second connector configured to releasably connect a first end of the second vertical bar to a first end of the second side bar, wherein a second end of the second vertical bar connects with the second end of the foldable upper bar through the third rotatable joint and a second end of the second side bar connects with the second end of the foldable lower bar through the fourth rotatable joint.

17. The method of claim 16, wherein the foldable upper bar, the foldable lower bar, the first slanted bar, and the second slanted bar comprise a tubular foldable upper bar, a tubular foldable lower bar, a tubular first slanted bar, and a tubular second slanted bar.

18. The method of claim 17, further comprising:

providing a cord interior to the tubular foldable upper bar, the tubular foldable lower bar, the tubular first slanted bar, and the tubular second slanted bar; and providing netting woven onto the foldable upper bar, the foldable lower bar, the first and second vertical bars, and the first and second side bars.

* * * * *